US009803872B1

(12) United States Patent
Lu et al.

(10) Patent No.: US 9,803,872 B1
(45) Date of Patent: Oct. 31, 2017

(54) AUTOMATIC HEAT-SOURCE SHUT-DOWN SYSTEM FOR COOKING STOVES

(71) Applicants: Bin Lu, Saratoga, CA (US); Robert Brownstein, Santa Cruz, CA (US)

(72) Inventors: Bin Lu, Saratoga, CA (US); Robert Brownstein, Santa Cruz, CA (US)

( * ) Notice: Subject to any disclaimer, the term of this patent is extended or adjusted under 35 U.S.C. 154(b) by 0 days.

(21) Appl. No.: 15/338,314

(22) Filed: Oct. 28, 2016

(51) Int. Cl.
*H05B 1/02* (2006.01)
*F24C 7/08* (2006.01)

(52) U.S. Cl.
CPC ..... *F24C 7/082* (2013.01)

(58) Field of Classification Search
CPC ..... F23N 5/203; F23N 5/10; F23N 2023/22; F23N 2037/02; F23N 2037/2041; F23N 2037/08; F23N 2027/36
USPC ..... 99/332, 347; 137/66, 614.12, 624.11, 137/625.47; 219/518
See application file for complete search history.

(56) References Cited

U.S. PATENT DOCUMENTS

| | | | | |
|---|---|---|---|---|
| 3,595,273 | A * | 7/1971 | Kolodziej | F16K 31/48 137/614.12 |
| 5,243,172 | A | 9/1993 | Hazan | |
| 5,658,478 | A | 8/1997 | Roeschel | |
| 5,746,114 | A | 5/1998 | Harris | |
| 6,253,761 | B1 | 7/2001 | Shuler et al. | |
| 7,117,893 | B1 * | 10/2006 | Krupa | F16K 31/485 137/624.11 |
| 7,913,615 | B2 | 3/2011 | Calzada | |
| 8,574,649 | B2 | 11/2013 | Lin | |
| 8,931,473 | B2 | 1/2015 | Baier et al. | |
| 2002/0094498 | A1 * | 7/2002 | Rodriguez-Rodriguez | F23N 5/203 431/18 |
| 2002/0113062 | A1 | 8/2002 | Cranford | |
| 2005/0063132 | A1 * | 3/2005 | Chen | F24C 3/124 361/247 |
| 2005/0098170 | A1 | 5/2005 | Raynor | |

* cited by examiner

*Primary Examiner* — Thien S Tran
(74) *Attorney, Agent, or Firm* — Robert Brownstein

(57) ABSTRACT

The invention is an automatic heat-source shut-off system for cooking stoves. When a burner's flame is turned on, or an electric stove's heating element is turned on, the invention begins a timed sequence that upon expiring causes the heat-source control shaft to be returned to the heat-off position.

4 Claims, 6 Drawing Sheets

AUTOMATIC HEAT-SOURCE SHUT-DOWN SYSTEM FOR COOKING STOVES

TECHNICAL FIELD

This invention is associated with cooking stoves.

BACKGROUND OF THE INVENTION

Cooking stoves that use natural gas or propane fuel typically have several burners below cook-top grills and individual controllers for flame height and heat output. Electric cooking stoves have resistive heating elements that radiate heat by converting electric current supplied to them. Controls have become essentially standardized with removable knobs on the end of heat-source control shafts, the rotation of which controls the amount of gas flow and, therefore, flame height and heat output; or in the case of electric stove, the amount of electric current converted to heat.

At one rotation point, there is no further rotation allowed and the gas supply or electric current is cut off. At the opposite rotation points gas flow or electric current is on and the amount of heat is determined by heat-source shaft rotation position.

Turning gas flow or electric current on or off is a manual process that requires a user to be present for either action. Currently, there are no safety features that will automatically turn off a burner's gas supply, or an electric stove's heat element current, based on time duration. Therefore, it is possible that a control may inadvertently be left with gas supply or electric current turned on causing at a minimum burning of food and cookware; and worst-case, causing fire and destruction of property and even lives.

BRIEF SUMMARY OF THE INVENTION

The invention disclosed and claimed herein is a system which is inserted between a removable knob and stove control facing, with the heat-source control shaft passing through, such that it may measure the time duration of a burner in gas-on state, or heating element in a current-on state, and automatically rotate the heat-source shaft to an off state after some programmed duration time has elapsed.

Some stoves have burner or heat element controls which turn gas supply or electric current on with clockwise rotation and off with end-point counter-clockwise rotation. Other stoves have controls which turn gas supply or electric current on with counter-clockwise rotation and off with end-point clockwise rotation. This invention can be used with either case.

The ways in which control knobs and heat-source control shafts interface may vary. For example, a shaft may be cut in a half-circle key that fits a knob having a complementary interface structure. The invention enables a separate adapting subsystem to be inserted such that it will permit use and control with all known knob and shaft interface designs

BRIEF DESCRIPTIONS OF THE DRAWINGS

Figure 3:
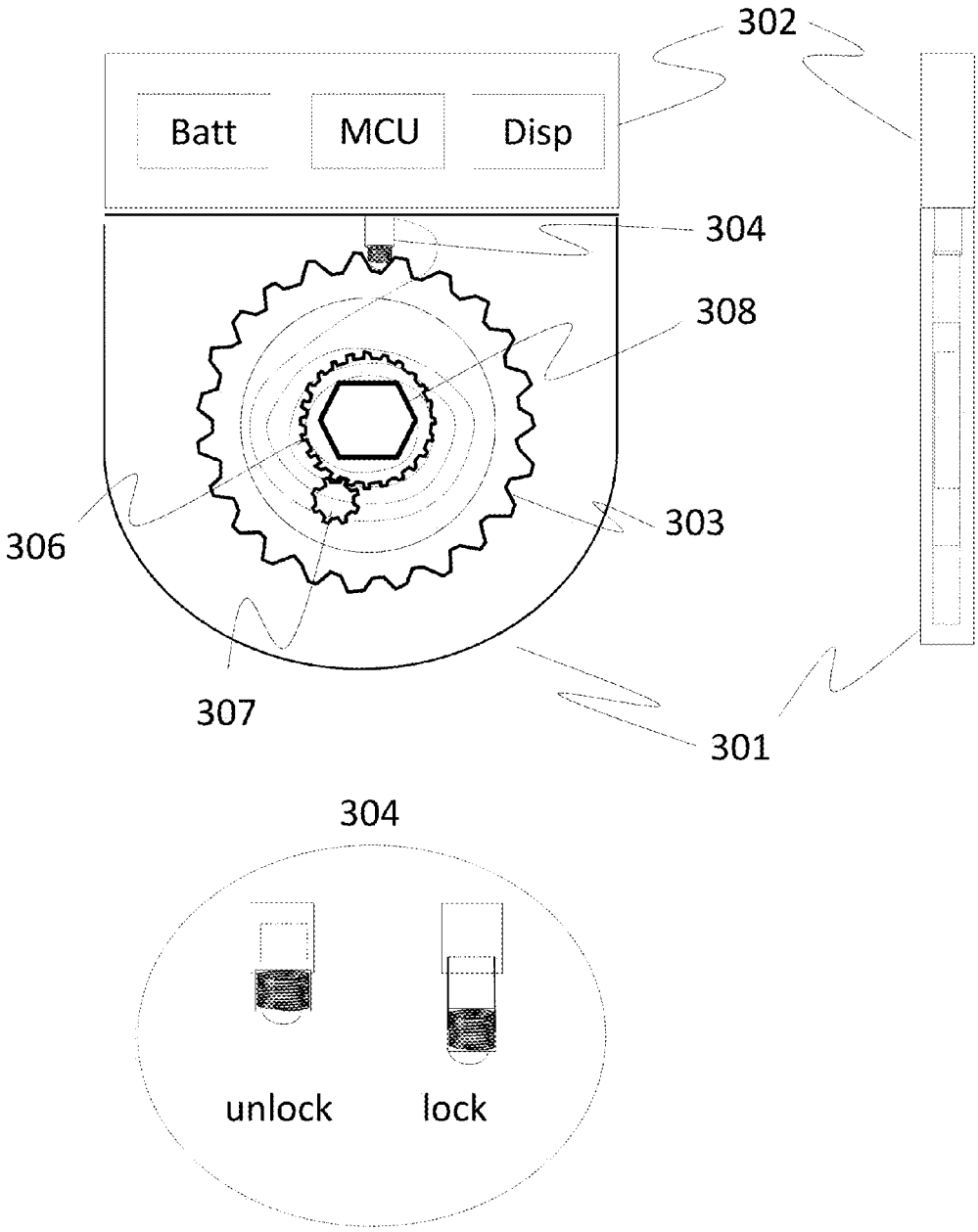
Figure 4:
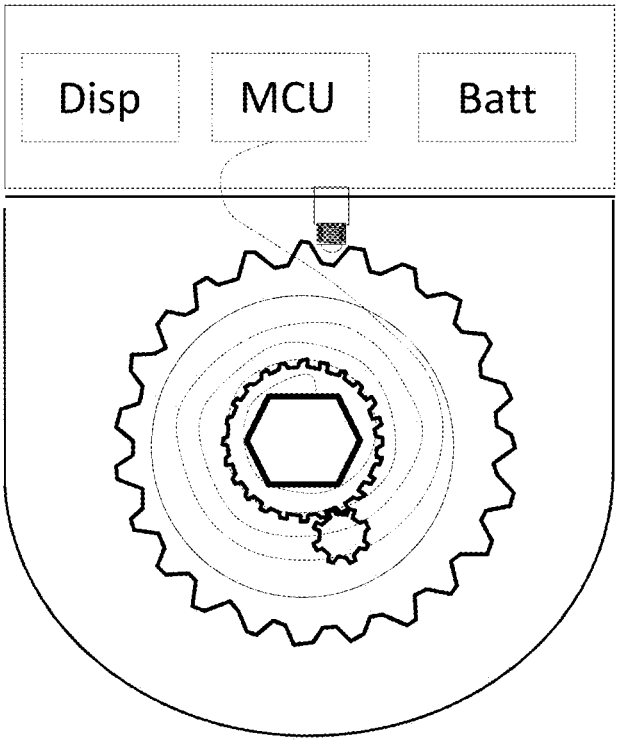

FIG. 3 depicts an embodiment of the invention including its constituent structures. This embodiment controls a burner or heating element where end-point clockwise rotation turns gas or electric current off FIG. 4 depicts an embodiment of the invention including its constituent structures. This embodiment controls a burner or heat element where end-point counter-clockwise rotation turns gas or electric current off.

Figure 5:
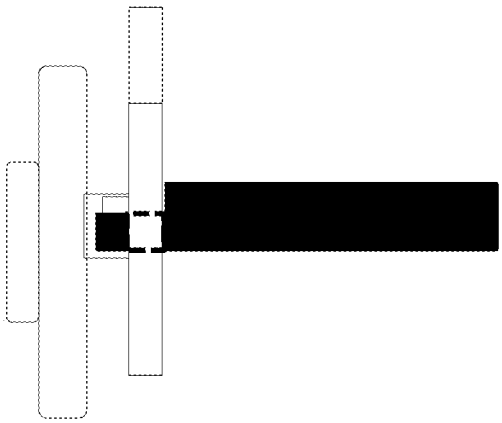

FIG. 5 illustrates how the invention interfaces with a heat-source control shaft and removable knob.

Figure 6:
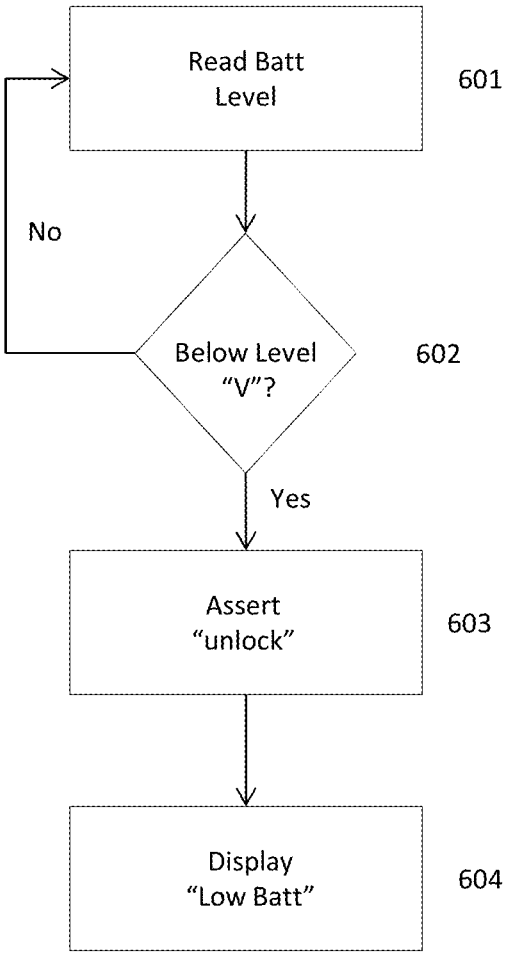

FIG. 6 is a flow diagram of the fail-safe low-battery operation.

Figure 7:
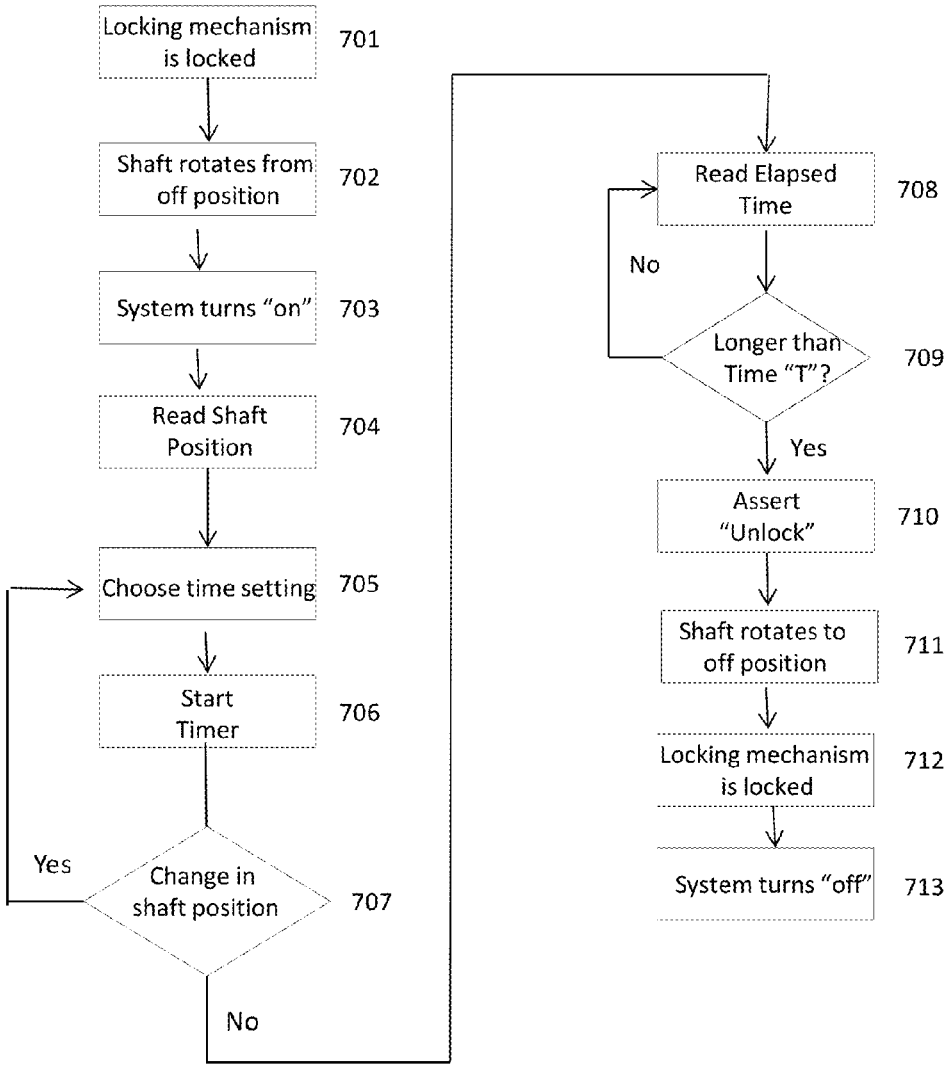

FIG. 7 is a flow diagram of the timed automatic shut-off operation.

DETAILED DESCRIPTION OF INVENTION

Gas stoves used for cooking typically have multiple cooktops with individual burners associated with each cook top. One turns on and controls the gas flow to each burner using a gas-valve and control knob assigned to each burner. Electric stoves have separate heating elements. One turns on and controls electric current using a heat-source control and control knob assigned to each heating element. Herein, the term "heat-source control shaft" will be used to indicate either a gas-valve control or heating-element control shaft.

A heat-source off state is controlled by rotating a control knob to a rotation end point. In some cases the rotation is clockwise to the end point; in others it is counter-clockwise; but in all cases that end point rotation position results in a cut off of either gas or electric current.

Rotating a control knob in a direction from the off position will initiate gas flow or electric current flow and heat output. In some cases, a knob must first be pushed toward the control facing before it can be rotated. As the knob is rotated, gas flow or electric current will increase or decrease commensurately. When a desired heat output is reached, one leaves the knob in that rotation position.

Figure 1:
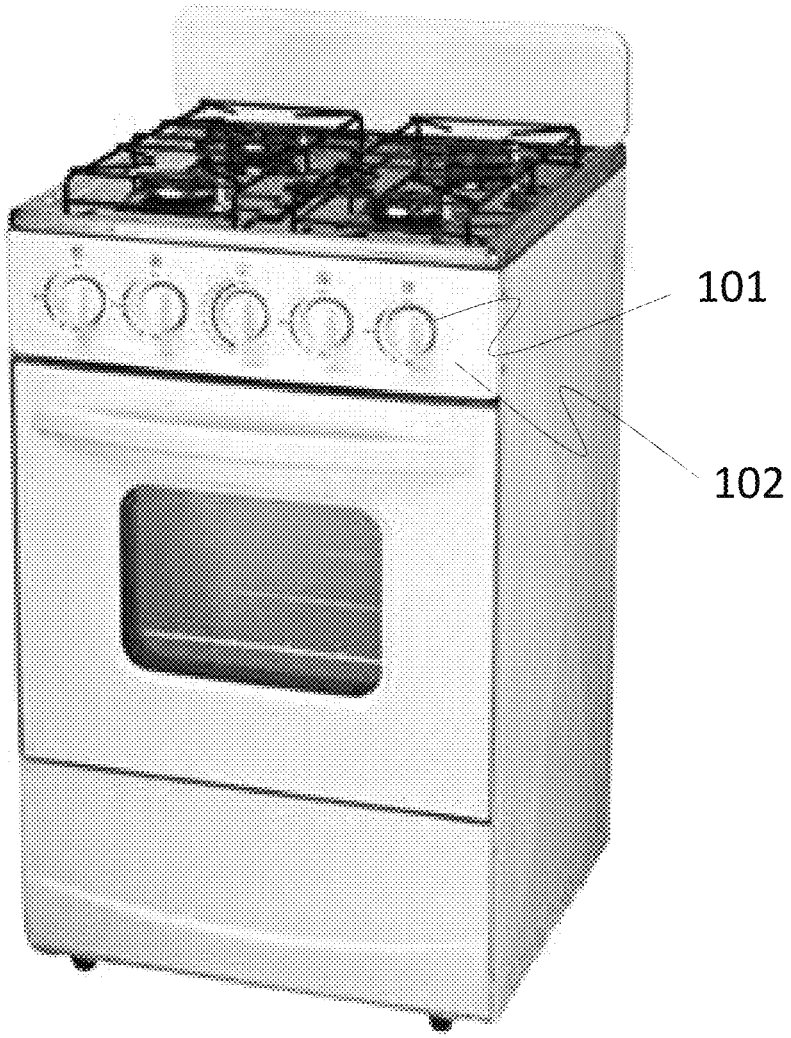
FIG. 1 depicts an exemplary gas stove showing the control facing and control knob.

In FIG. 1, an exemplary gas stove is depicted and the control knob (101) is shown with the stove control facing (102) behind it. The knobs are typically removable by pulling away from the stove control facing. Afterward, the heat-source control shaft is exposed and it typically extends some distance in front of the stove control facing.

Figure 2:
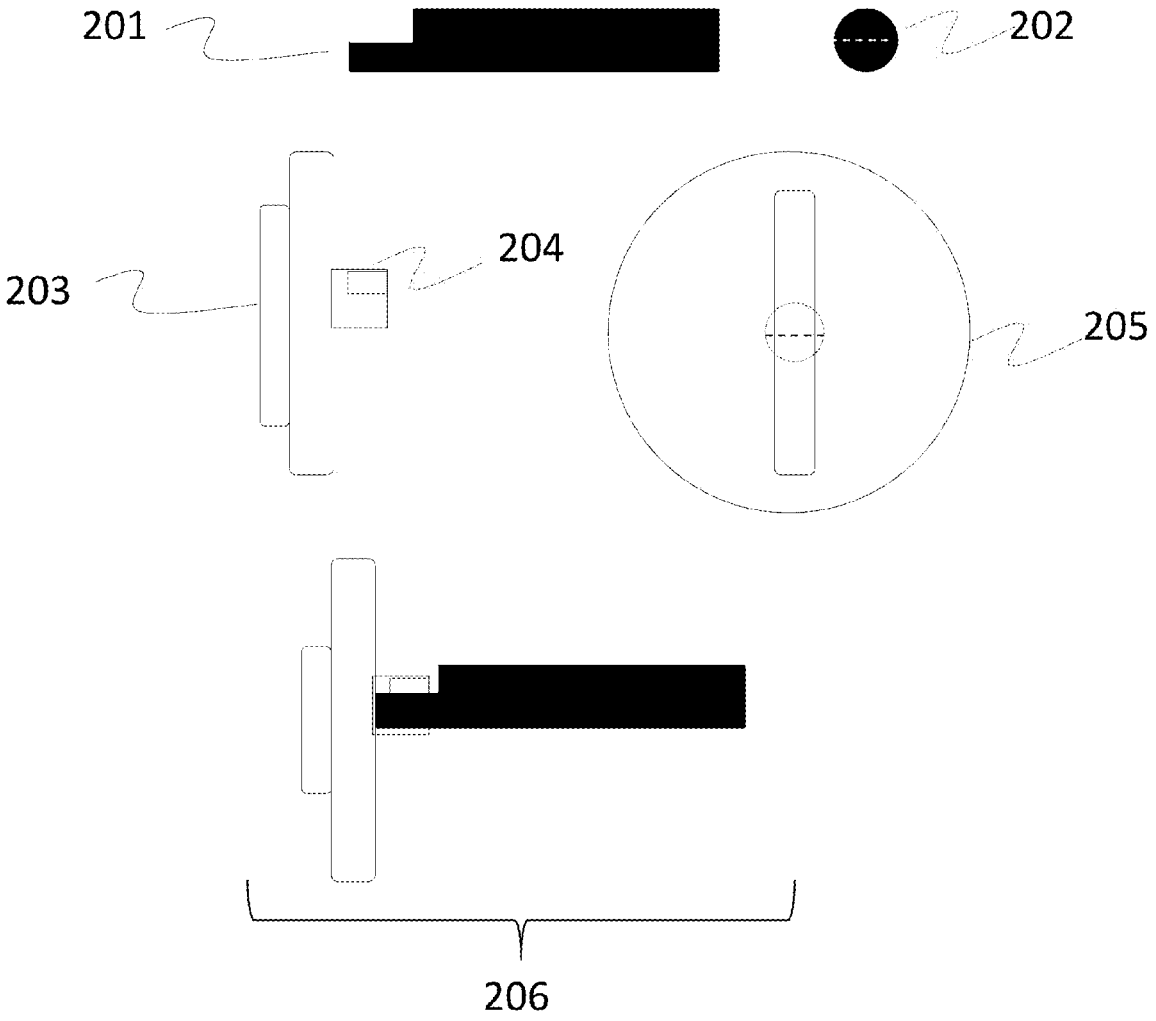
FIG. 2 depicts a side view and front view of a heat-source control shaft, a side and front view of a removable control knob, and a side view showing how the two interface with one another.

Control knobs and heat-source control shafts are designed to interface such that the knob when pressed onto the shaft fits snugly and any rotation of the knob will cause commensurate rotation of the shaft. There should be no slippage. FIG. 2 shows a side (201) and front view (202) of a heat-source control shaft where the end has been shaped into a half-rounded key. The knob is shown from side (203) and front (205) and its interfacing structure (204) will accept that half-rounded key and fit snugly on the key end of the heat-source control shaft. The final view (206) of FIG. 2 shows the knob and shaft interfaced to one another. Note that this is exemplary and the key may be other than a half-round key.

One embodiment of the invention (FIG. 3) illustrates a system comprising two subsystems; a mechanical subsystem (301) and an electronic subsystem (302). The mechanical subsystem has a gear structure or structures (303) that rotate with the knob and shaft and in doing so develop a spring tension (305) operative to apply a rotation force in the opposite direction and of sufficient magnitude to be able to return the shaft to a heat-source off position. A tooth pattern on the gear structure operating in conjunction with a locking mechanism (304) will hold the knob in a fixed shaft position when rotation force is stopped. The knob and shaft may be turned by a user in either direction because the locking mechanism will respond to rotation force but lock when force is removed. The locking mechanism responds to electrical signals that represent locking or unlocking commands. In addition, as part of the same gear structure, a second gear (306) also rotates with the rotation of the shaft, and this second gear structure causes a third gear structure (307) to rotate in lock-step with it. This third gear structure will in turn vary the resistance of a variable resistor such that the resistance represents the control shaft rotation position. Control-shaft position can be used to choose a timer setting. For example, if the shaft is rotated to a low heat position for simmering, the timer setting may be a relatively long duration. If the shaft position represents high heat, the timer setting would be of shorter duration. Timer settings may be automatically selected based on the shaft-position information. An increment or decrement control may be included with the electronic subsystem to allow a user to add or diminish the selected duration time. Using a variable resistor to represent shaft-position is only one method for doing so, and is meant to be exemplary. To reiterate, the mechanical subsystem rotates with the shaft, develops an opposition tension that wants to return the shaft to its initial position (e.g. off) and turns a variable resistor whose resistance represents the shaft position. The electronic subsystem comprises a controller IC (MPU), a liquid-crystal display (DISP), and an electric power source (BATT). The electronic subsystem is operative to receive a shaft rotation signal from the mechanical subsystem, to turn on when the knob and shaft have been rotated from an off position, and to then begin measuring time duration against a predetermined value. When time duration exceeds this programmed value, the electronic subsystem signals the locking mechanism to unlock rotation thereby allowing the stored spring tension to effectively rotate the shaft to an off position. Once the shaft returns to this off position, the system is turned off. Since the operation of the mechanical subsystem is affected by the signals emitted and received by the electronic subsystem, there needs to be a fail-safe mechanism that prevents locking the rotation when a battery reaches some discharge level. When a battery has dropped to a lower limit of voltage, a warning will appear on the LCD display and the locking mechanism will assume an unlock position. As such, any attempt to turn the knob to a heat-source on position will not be locked and instead the shaft will rotate back to an off position until a battery with sufficient voltage is inserted in the electronic subsystem. In addition, the electronic subsystem display face will have a button and switch (not shown) that effectively cancels the action of the system and returns the knob and shaft to an off position, which also turns off the system. Optionally, a low-power wireless link to a wireless hub can be used to issue a warning to a user via an application running on a mobile device. The application may also permit the user to issue a cancel command, remotely and wirelessly, which works the same way as the physical cancel button and switch, that is, it ends the system's action and enables the shaft to automatically return to an off position, effectively turning the system off, too.

It should be noted that shaft rotation direction may vary. Some stoves turn on the gas or electric current and adjust the heat by turning clockwise; others do so by turning counterclockwise. The invention allows for both cases. FIG. 3's embodiment, for example, works with stoves whose shafts turn heat off by rotating clockwise. FIG. 4 is simply the same as FIG. 3 but where the system is flipped around such that the mechanical subsystem is now oriented to work with stoves whose shafts turn heat off by rotating in a counterclockwise direction. This allows a single invention to be used for either case. The electronic subsystem can interface with the mechanical subsystem regardless of its orientation such that the display and controls always face the user.

The mechanical subsystem (301) and electronic subsystem (302) may be separately housed and interface along their edges as shown in FIGS. 3 and 4. When connected by their edges, holes and guides (not shown) will allow the two to align with one another, and an electrical connection interface (not shown) will allow signals to be received from the mechanical subsystem by the electronic subsystem, and vice-versa. Where the control facing is not a flat surface, and the two subsystems cannot be physically interconnected, the conducting path that conveys signals between the two subsystems may be implemented using a connecting cable. All features of the invention, including fail-safe low-battery turn off would still be operational.

An essential feature of the invention is a fail-safe operation that detects low battery condition and unlocks the shaft rotation to allow the spring tension to return the shaft to an off position. As shown in FIG. 6, the electronic subsystem reads battery level (601) and as long as the level is above some predetermined voltage level, V, normal operation of the invention continues unabated. However, if the voltage level drops below V (602), the electronic subsystem asserts the unlock state (603) of the locking mechanism allowing the spring tension to rotate the shaft to an off position. A low-battery indication will also be displayed on the liquid-crystal display (604). So long as the voltage is below level V, the unlock state persists and the control knob and shaft cannot be placed in a heat-on position because as soon as one's hand is removed from the knob, the spring will rotate the shaft to the off position. This operation supersedes other operations. Until the battery is replaced and voltage level exceeds V, or the user manually sets a switch which forces the locking mechanism into lock position. the burner or heat element cannot be turned on and left on.

FIG. 7 is a flow diagram that shows one embodiment of the invention's operating control flow. Initially, when the heat-source control shaft is in the heat-off position, the invention system is off, the locking mechanism is locked, and no electrical charge is consumed (701). When the shaft is rotated from the off position (702), however, the unit turns on (703). The electronic subsystem receives shaft position information (704) and a timer setting is chosen based on shaft-position (705). The timer function is started and the predetermined timer setting value is set (706). The locking mechanism continues in a locked position. This will allow the knob to be turned in either direction but its position will be fixed when rotation force is removed. If the knob is turned at any time during the cooking cycle, its position change will be detected (707) and the information may cause a timer reset. With the knob and control shaft in a heat-source on position, the system monitors the timer to read elapsed time (708). So long as the elapsed time is below the value of the timer setting, the knob remains locked in position (709). However, when elapsed time equals the timer setting, the system will assert unlock (710) and the locking mechanism will latch into an unlocked position effectively allowing the control shaft to be rotated to its end-point rotation position and turning off the heat source (711), placing the locking mechanism in lock position (712) and the system is turned off (713). During cooking time if the user turns the knob to adjust the shaft, the software may reset the timer. For example, if the shaft is rotated such that a low-heat level is replaced by a high-heat level, the time may be automatically reset to a shorter (high-heat) setting. The decision to reset or not is determined by the MCU based on new shaft position and prior shaft position. A change that does not cause a shift from high to low, or high to medium, may not trigger a reset, for example.

During heat-off periods, the system is off and no battery drain occurs. During heat-on, polling of the timer is periodic and asserting lock is a latched operation where a momentary current places the locking mechanism into position with the gear teeth. No continuous current is consumed. Thus, the invention requires very little electrical energy to operate, and the fail-safe low-battery feature ensures that the heat-on state is terminated when battery voltage falls below a safe level.

As described, the control shaft protrudes beyond the control facing, and uses a half-round key interface with the knob. In some cases, the key may have a different interface shape, and the shaft may not extend beyond the control facing. In those cases, adaptors may be used to provide the appropriate key shape for the knob-shaft interface, and shaft, and gear; and an extension shaft adaptor can be used to extend the shaft such that with the system invention in place, the knob may be reattached to the existing control shaft and provide slippage free rotation.

The mechanical subsystem housing, once oriented for proper use with a particular stove and its heat-source control shaft can be mounted into position using a sheet of dual-sided adhesive that adheres to the back face of the mechanical subsystem and the stove control facing. The adhesive will be sufficiently strong and durable so as to prevent the mechanical subsystem housing from rotating and reducing the spring tension. Adhesives that meet and exceed these requirements are readily available.

The gears will be made of materials that permit both thinness and durability. Certainly metallic materials can be used; but sufficiently robust molded materials may also be used. The main spring structure that provides the spring tension must have sufficient stored energy to rotate the shaft regardless of its locked position when released. It must bring the shaft to the off position.

The disclosure and drawings are meant to be exemplary and should not be read as limiting the scope of the invention. Furthermore, although the examples given herein are specific to a stove application, the invention would be operative to provide shaft control for any other device where an end-point rotation is desired after some time has elapsed. It could, for example, turn a lock cylinder shaft.

What is claimed is:

1. A system comprising:

an electronic subsystem;

a mechanical subsystem;

at least one conductive path allowing signals to be conveyed between said electronic and mechanical subsystems;

said electronic subsystem comprising a controller, a display and a voltage source;

said electronic subsystem is powered off when a control shaft is in an off position;

said electronic subsystem is powered on when said control shaft is not in said off position;

said electronic subsystem operative to receive said control shaft rotation position information after being powered on;

said electronic subsystem operative to measure time duration, initiate display of elapsed time on a display, and initiate a time-related control signal;

said electronic subsystem using elapsed time operative to initiate a locking or unlocking control signal;

said electronic subsystem operative to measure said voltage source voltage level;

said electronic subsystem operative to initiate said unlocking control signal, and to initiate a display of a low-battery condition icon on said display, when said source voltage level falls below some predetermined voltage level;

said mechanical subsystem comprising:

a first gear structure operative to rotate when said control shaft rotates;

a main spring operative to increase and store oppositional rotation force as said first gear structure is rotated;

said first gear structure operative to allow rotation of said shaft in both directions in response to an unlocking signal from said electronic subsystem;

said first gear structure operative to allow, in response to a locking signal from said electronic subsystem, rotation of said shaft in either a clockwise or counterclockwise direction in response to a user's rotation force, and to preserve said shaft position once rotation force is removed;

a second gear structure operative to rotate when said control shaft rotates and to generate a shaft-position signal;

an electro-mechanical locking mechanism operative to lock or unlock rotation of said first gear structure in accordance with said locking and said unlocking signals received from said electronic subsystem.

2. A claim as in claim 1 further comprising:

said mechanical subsystem in a mechanical subsystem housing operative to be inserted with said control shaft passing through said mechanical subsystem and through said first gear structure;

said mechanical subsystem housing to be mounted securely to a control facing through which said control shaft extends.

3. A claim as in claim 1 further comprising:

said electronic subsystem and said mechanical subsystem interfaced such that said one or more conductive path extends between said housings allowing signals to be conveyed between said electronic subsystem and said mechanical subsystem.

4. A claim as in claim 1 further comprising:

said electronic subsystem in an electronic subsystem housing operative to interface with said mechanical subsystem housing via interfacing edges and edge connectors.

* * * * *